US010316704B2

(12) United States Patent
Zschieschang

(10) Patent No.: US 10,316,704 B2
(45) Date of Patent: Jun. 11, 2019

(54) CAMSHAFT ADJUSTING DEVICE

(71) Applicant: Schaeffler Technologies AG & Co. KG, Herzogenaurach (DE)

(72) Inventor: Torsten Zschieschang, Hagenbuechach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 98 days.

(21) Appl. No.: 15/126,948

(22) PCT Filed: Jan. 12, 2015

(86) PCT No.: PCT/DE2015/200000
§ 371 (c)(1),
(2) Date: Sep. 16, 2016

(87) PCT Pub. No.: WO2015/144140
PCT Pub. Date: Oct. 1, 2015

(65) Prior Publication Data

US 2017/0096915 A1 Apr. 6, 2017

(30) Foreign Application Priority Data

Mar. 26, 2014 (DE) ..... 10 2014 205 569

(51) Int. Cl.
*F01L 1/34* (2006.01)
*F01L 1/344* (2006.01)
(Continued)

(52) U.S. Cl.
CPC ..... *F01L 1/344* (2013.01); *F01L 1/047* (2013.01); *F01L 1/3442* (2013.01); *F01L 9/02* (2013.01);
(Continued)

(58) Field of Classification Search
CPC ..... F01L 1/344; F01L 1/3442; F01L 2001/34426; F01L 2001/34463; F01L 2001/34466
(Continued)

(56) References Cited

U.S. PATENT DOCUMENTS 8,205,586 B2 6/2012 Strauss et al.
8,640,662 B2 2/2014 Cole et al.
(Continued)

FOREIGN PATENT DOCUMENTS

CN 1061470 5/1992
DE 102007007072 8/2008
(Continued)

*Primary Examiner* — Ching Chang
(74) *Attorney, Agent, or Firm* — Davidson, Davidson & Kappel, LLC

(57) ABSTRACT

A vane cell adjuster including
a central locking device for locking the rotor in a central locking position, wherein
the central locking device has at least two spring-loaded locking pins which can be locked in a stator-fixed locking slotted guide and which, during a rotation of the rotor from the direction of an "early" or "late" stop position, lock into the central locking position from different directions in the locking slotted guide, wherein
a locking pin forms a valve unit with the respective accommodation chamber, wherein
in a first switch position of the valve unit, at least one first pressure medium line is connected to allow free flow to a second pressure medium line, and
in a second switch position of the valve unit, the first pressure medium line is connected to allow flow via a check valve to the second pressure medium line, wherein
(Continued)

the check valve is provided in the rotor outside of the locking pin.

8 Claims, 3 Drawing Sheets

(51) Int. Cl.
*F01L 1/047* (2006.01)
*F01L 9/02* (2006.01)

(52) U.S. Cl.
CPC ..... *F01L 2001/34426* (2013.01); *F01L 2001/34463* (2013.01); *F01L 2001/34466* (2013.01)

(58) Field of Classification Search
USPC ..... 123/90.15, 90.17
See application file for complete search history.

(56) References Cited

U.S. PATENT DOCUMENTS

| | | | | |
|---|---|---|---|---|
| 8,752,516 | B2 | 6/2014 | Takada | |
| 8,800,512 | B2 | 8/2014 | Strauss | |
| 9,765,655 | B2 * | 9/2017 | Zschieschang ..... | F01L 1/3442 123/90.17 |

FOREIGN PATENT DOCUMENTS

| | | | |
|---|---|---|---|
| DE | 102008008005 | | 8/2009 |
| DE | 102008011915 | A1 | 9/2009 |
| DE | 102008011916 | A1 | 9/2009 |
| DE | 102009002805 | | 11/2010 |
| DE | 102012013510 | | 3/2013 |
| WO | WO2012/094324 | | 7/2012 |

* cited by examiner

CAMSHAFT ADJUSTING DEVICE

The present invention relates to a camshaft adjusting device.

Camshaft adjusting devices are generally used in valve train assemblies of internal combustion engines to vary the valve opening and closing times, whereby the consumption values of the internal combustion engine and the operating behavior in general may be improved.

BACKGROUND

One specific embodiment of the camshaft adjusting device, which has been proven and tested in practice, includes a vane adjuster having a stator and a rotor, which delimit an annular space, which is divided into multiple working chambers by projections and vanes. A pressure medium may be optionally applied to the working chambers, which is supplied to the working chambers on one side of the vanes of the rotor from a pressure medium reservoir in a pressure medium circuit via a pressure medium pump, and which is fed back into the pressure medium reservoir from the working chambers on the particular other side of the vanes. The working chambers whose volume is increased have an operating direction which is opposite the operating direction of the working chambers whose volume is decreased. As a result, the operating direction means that an application of pressure medium to the particular group of working chambers induces a rotation of the rotor relative to the stator either in the clockwise or the counterclockwise direction. The control of the pressure medium flow, and thus the adjusting movement of the camshaft adjusting device, takes place, e.g., with the aid of a central valve having a complex structure of flow-through openings and control edges, and a valve body, which is movable within the central valve and which closes or unblocks the flow-through openings as a function of its position.

One problem with camshaft adjusting devices of this type is that the camshaft adjusting devices are not yet completely filled with pressure medium in a start phase or may even have been emptied, so that, due to the alternating torques applied by the camshaft, the rotor may execute uncontrolled movements relative to the stator, which may result in increased wear and an undesirable noise development. To avoid this problem, it is known to provide a locking device between the rotor and the stator, which locks the rotor when the internal combustion engine is turned off in a rotation angle position with respect to the stator which is favorable for startup. In exceptional cases, for example if the internal combustion engine is stalled, it is possible, however, that the locking device does not properly lock the rotor, and the camshaft adjuster must be operated with an unlocked rotor in the subsequent start phase. However, since some internal combustion engines have a very poor start behavior if the rotor is not locked in the central position, the rotor must then be automatically rotated into the central locking position and locked in the start phase.

Such an automatic rotation and locking of the rotor with respect to the stator are known, for example, from DE 10 2008 011 915 A1 and from DE 10 2008 011 916 A1. Both locking devices described therein include a plurality of spring-loaded locking pins, which successively lock into locking gates provided on the sealing cover or the stator when the rotor rotates and which each permit a rotation of the rotor in the direction of the central locking position before reaching the central locking position while blocking a rotation of the rotor in the opposite direction. After the internal combustion engine has warmed up and/or the camshaft adjuster has been completely filled with pressure medium, the locking pins are forced out of the locking gates, actuated by the pressure medium, so that the rotor is subsequently able to properly rotate with respect to the stator to adjust the rotation angle position of the camshaft.

SUMMARY OF THE INVENTION

One disadvantage of this approach is that the locking of the rotor may be accomplished only with the aid of multiple successively locking locking pins, which results in higher costs. In addition, the locking procedure requires that the locking pins lock successively in a fail-safe manner. If one of the locking pins does not lock, the locking procedure may be interrupted, since the rotor is thus not locked in the intermediate position on one side and is unable to rotate back.

[An object of the present invention is therefore to provide a camshaft adjuster which has a fail-safe and cost-effective central locking of the rotor.

According to the basic idea of the present invention, the check valve is provided outside the locking pin in the rotor. Due to the check valve, the pressure medium is able to flow into the enlarging working chamber without it being able to be forced back out of this working chamber in the case of a torque acting upon the camshaft and oriented in the opposite direction. The check valve thus effectively forms a type of freewheel, which uses the active alternating torque to automatically rotate the rotor in a pulsating manner from the direction of the stop position in the direction of the central locking position. It is particularly important that the remaining working chambers are short-circuited during the inflow of the pressure medium, so that the pressure medium contained therein is able to flow over between the other working chambers and does not hinder the rotational movement. The check valve is preferably situated in a rotor hub of the rotor and outside the locking pin. The advantage of such an arrangement of the check valve is that the check valve does not have to be integrated into the locking pin, which is difficult to implement structurally, due to the limited installation space. Moreover, positioning the check valve in the rotor hub in spatial proximity to the locking pin enables pressure medium to flow through the check valve as a function of the position of the locking pin, even with a simple guidance of the pressure medium lines.

It is furthermore proposed that at least two valve devices are provided. Due to the two valve devices, two check valves may be switched as needed between two oppositely acting working chambers as a function of the particular assigned valve device. Central locking devices known from the prior art usually include a first and a second locking pin. Depending on whether the camshaft adjusting device is moved into the central locking position from the "advance" or "retard" direction, only one locking pin is in a first switching position in each case, since the other locking pin is held in a second switching position by the locking gate. The valve device is preferably formed by the locking pins and a receiving chamber which guides the locking pin. Alternatively, the position of the locking pin may be used to control a separate valve device, which is not formed by the locking pin and the receiving chamber. Due to the two valve devices, a first or a second check valve may thus be fluidically connected to two oppositely acting working chambers as a function of the position of the locking pins—and thus as a function of the rotation direction.

It is furthermore preferred that the adjacent first pressure medium line is divided into a pressure medium line having a check valve and a second pressure medium line with a free flow-through. Due to this arrangement of the pressure medium line, the check valve may be situated in the rotor hub and does not have to be accommodated in the locking pin. This results in the advantage that, with the aid of the position of the locking pin, a fluidic connection of a first pressure medium line may be established to a second pressure medium line via a fourth pressure medium line with a free flow-through or a third pressure medium line having a check valve. A 3/2-way valve is preferably used for this purpose. In a first switching position of the valve device, the first pressure medium line is fluidically connected to the second pressure medium line via the third pressure medium line having the check valve, while in a second switching position of the valve device, the first pressure medium line is fluidically connected to the second pressure medium line via the fourth pressure medium line with a free flow-through. In this context, a pressure medium line with a free flow-through is understood to be a pressure medium line, through which pressure medium may flow unhindered or essentially unhindered in both flow directions; a pressure medium therefore is unable to flow freely through a pressure medium line having a check valve.

It is furthermore proposed that a pressure medium line having a check valve is provided at at least two of the valve devices. In that at least two check valves are fluidically connected to one valve device, it is possible for the movement from the "advance" and "retard" positions into the central locking position to fluidically switch a different check valve between two working chambers having different operating directions. The operating direction of a first check valve is set in such a way that the fluidic connection of two oppositely acting working chambers is facilitated only with a movement from the "retard" position into the central locking position. In a second check valve, the operating direction is set in such a way that the fluidic connection of two oppositely acting working chambers is facilitated only with a movement from the "advance" position into the central locking position.

It is furthermore proposed that at least one of the working chambers, whose volume is decreased during a rotation of the rotor from the direction of one of the "advance" or "retard" stop positions in the direction of the central locking position, is fluidically short-circuited with another working chamber having the opposite operating direction, if at least one valve device is in the second switching position. This prevents the movement of the camshaft adjusting device from becoming blocked during a movement into the central locking position.

It is furthermore advantageous if a back-flow of the pressure medium from at least one of the additional working chambers is prevented by the check valve. Due to the two valve devices, the fluidic connection of two oppositely acting working chambers may be set via a check valve in such a way that the rotor is able to rotate relative to the stator in one direction in the start phase, due to the active alternating torques (camshaft torque actuated), while the rotational movement in the particular other direction is blocked by the check valve. The check valve thus virtually forms a type of freewheel, which uses the active alternating torque to automatically rotate the rotor in a pulsating manner from the direction of the stop position in the direction of the central locking position. It is particularly important that the remaining working chambers are short-circuited during the inflow of the pressure medium, so that the pressure medium contained therein is able to flow over between the other working chambers and does not hinder the rotational movement.

It is advantageous if at least one working chamber, whose volume is increased during the controlled adjustment of the stator relative to the rotor, is fluidically connected by the valve device to pressure medium pump P. This ensures that a controlled setting of the relative angle between the stator and the rotor may be established. For this purpose, the pressure medium pump is connected to at least one working chamber of an operating direction, whose volume increases during the adjusting movement. Due to the fluidic connection of the pressure medium pump to the working chamber via the valve device, it is ensured that the connection to the working chamber is established via the check valve as soon as the pressure medium line is depressurized. As a result, the residual pressure in the pressure medium line is used to move the camshaft adjuster in the direction of the central locking position when the internal combustion engine is turned off.

It is furthermore advantageous if at least one working chamber, whose volume decreases during the controlled adjustment of the stator relative to the rotor, is fluidically connected to pressure medium reservoir T. Due to the fluidic connection of the working chamber, whose volume decreases during an adjusting movement, to the pressure medium reservoir, the excess pressure medium may flow out.

BRIEF DESCRIPTION OF THE DRAWINGS

The present invention is explained in greater detail below on the basis of one preferred exemplary embodiment. The following are shown in detail in the figures.

DETAILED DESCRIPTION

Figure 1:
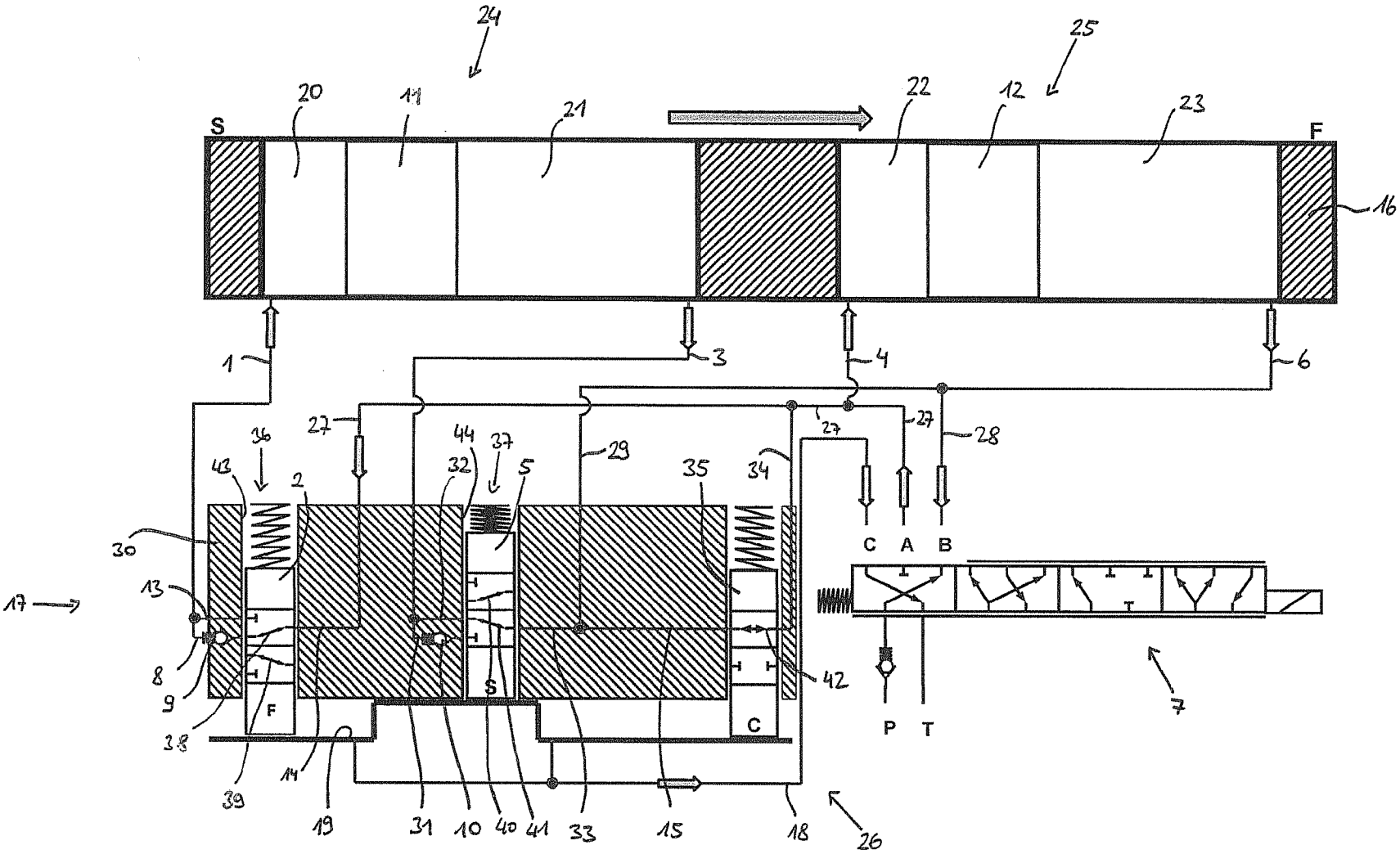
FIG. 1 shows a schematic representation of a camshaft adjusting device according to the present invention, including a circuit diagram of a pressure medium circuit in the position during an adjusting movement of the rotor from the "retard" position into the central locking position.
Figure 2:
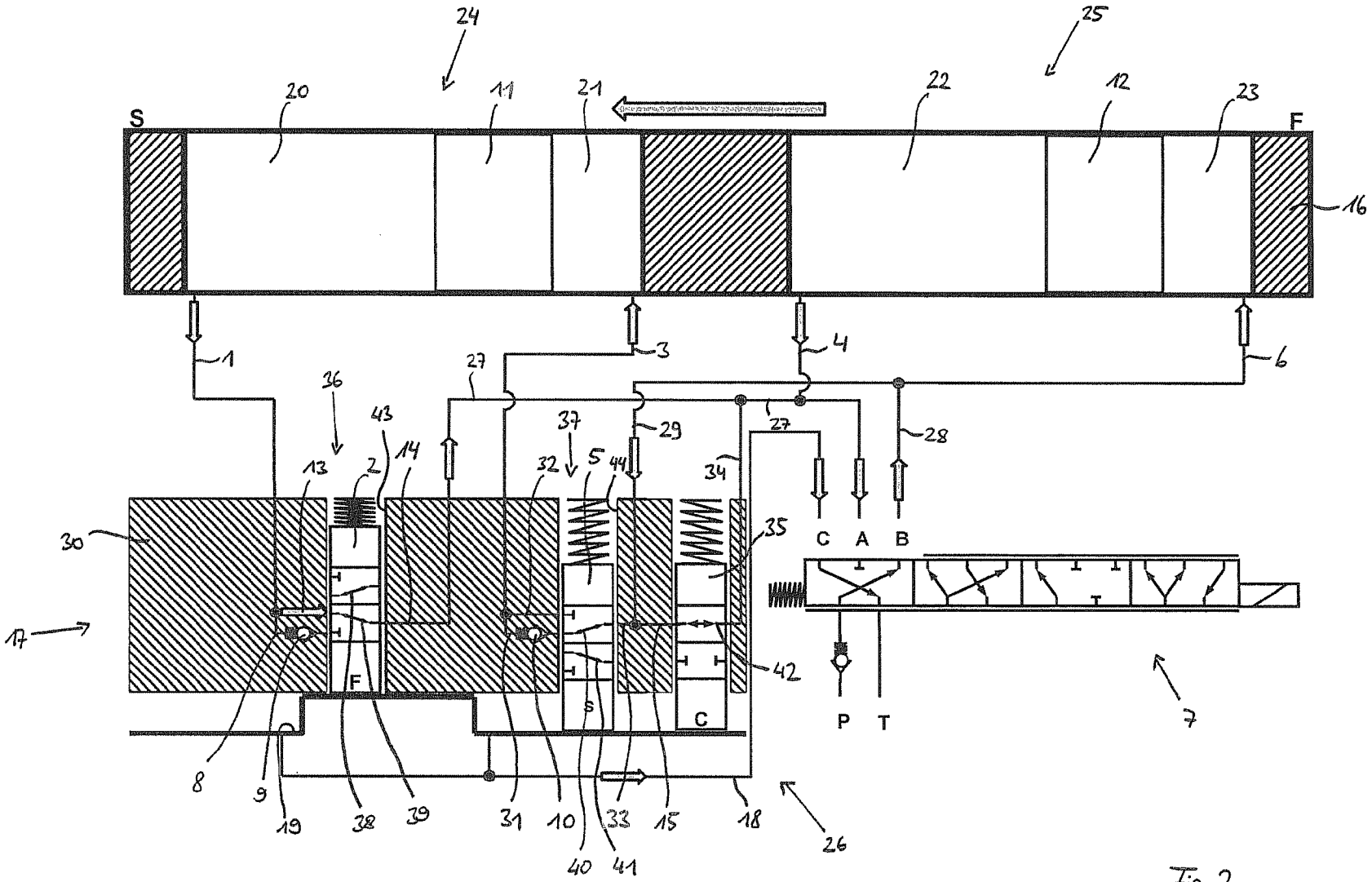
FIG. 2 shows a schematic representation of a camshaft adjusting device according to the present invention, including a circuit diagram of a pressure medium circuit in the position during an adjusting movement of the rotor from the "advance" position into the central locking position.
Figure 3:
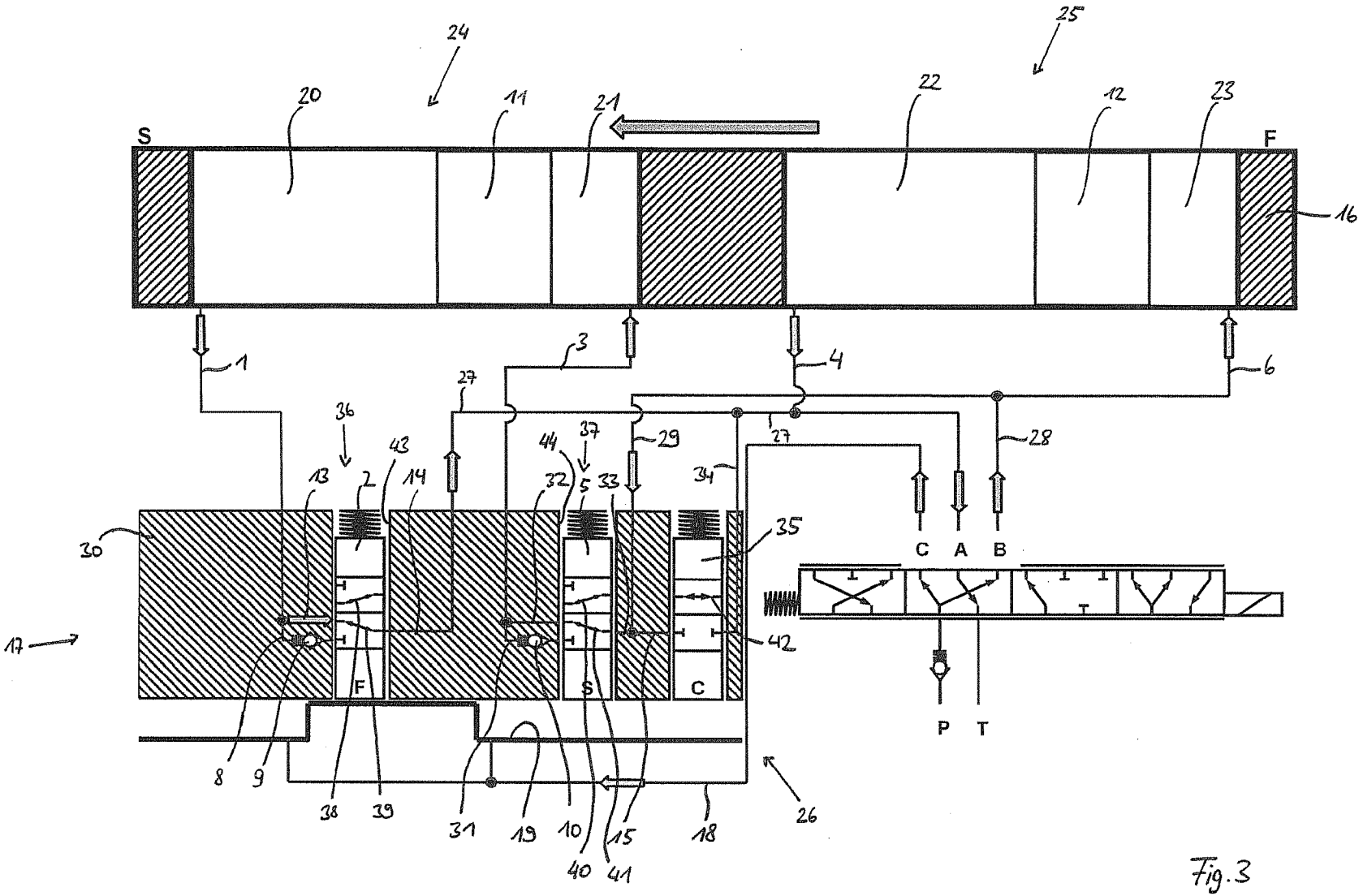
FIG. 3 shows a schematic representation of a camshaft adjusting device according to the present invention, including a circuit diagram of a pressure medium circuit during the adjusting movement in normal operation.

A camshaft adjusting device having a known basic structure with a schematically illustrated vane adjuster as a basic component is apparent from FIGS. 1 through 3, which includes a stator 16, drivable by a crankshaft which is not illustrated, and a rotor 17, which is rotatably fixedly connectable to a camshaft, also not illustrated, and which includes multiple vanes 11 and 12 extending radially outwardly. In the upper representation, the vane adjuster is apparent in the developed view, while a detail of rotor 17, which includes a central locking device 26, is schematically apparent at the bottom left, and a switching device in the form of a multi-way switching valve 7 for controlling the pressure medium flow is schematically apparent at the bottom right. Multi-way switching valve 7 has an A, B and C port, to which pressure medium lines 18, 27 and 28 are fluidically connected. Multi-way switching valve 7 is furthermore fluidically connected to a pressure medium reservoir T and a pressure medium pump P, which, upon an activation of the camshaft adjusting device, conveys the pressure medium from pressure medium reservoir T to a pressure medium circuit after the pressure medium has been fed back.

A pressure medium circuit is also apparent, which includes a large number of pressure medium lines 1, 3, 4, 6, 8, 13, 14, 15, 18, 27, 28, 29, 31, 32, 33, 34, 38, 39, 40, 41 and 42, which are fluidically connectable to pressure medium pump P or pressure medium reservoir T via multi-way switching valve 7.

Stator 16 includes a plurality of stator webs, which divide an annular space between stator 16 and rotor 17 into pressure chambers 24 and 25. Pressure chambers 24 and 25, in turn, are divided by vanes 11 and 12 of rotor 17 into working chambers 20, 21, 22 and 23, into which pressure medium lines 1, 3, 4 and 6 open. Central locking device 26 includes two locking pins 2 and 5, which lock into a stator-fixed locking gate 19 for the purpose of locking rotor 17 with respect to stator 16. Locking gate 19 may be situated, for example, in a sealing cover screwed to stator 16.

In principle, the rotation angle of the camshaft with respect to the crankshaft during normal operation, i.e., in the "retard" direction, is adjusted by the fact that pressure medium is applied to working chambers 21 and 23, thereby increasing their volume, while the pressure medium is simultaneously forced out of working chambers 20 and 22, which reduces their volume (see FIG. 3). In the illustrations, the "advance" stop position is identified by an F and the "retard" stop position by an S. Working chambers 20, 21, 22 and 23, whose volume is increased in groups during this adjusting movement, are referred to, within the meaning of the present invention, as working chambers 20, 21, 22 and 23 of one operating direction, while working chambers 20, 21, 22 and 23, whose volume is simultaneously decreased, are referred to as working chambers 20, 21, 22 and 23 of the opposite operating direction. The change in volume of working chambers 20, 21, 22 and 23 then results in the fact that rotor 17, including vanes 11 and 12, is rotated with respect to stator 16. In the top development drawing of stator 16, the volume of working chambers 21 and 23 is increased by applying pressure medium via the B port of multi-way switching valve 7, while the volume of working chambers 20 and 22 is simultaneously decreased by the back-flow of the pressure medium via the A port of multi-way switching valve 7. This change in volume then results in a rotation of rotor 17 with respect to stator 16, which results in a shifting of vanes 11 and 12 to the left in the direction of the arrow in the developed view in FIG. 3.

A valve function pin 35 is furthermore provided, which is also linearly shiftable and spring-loaded. Valve function pin 35 is spring-loaded in the direction of the position of engagement with locking gate 19 and is situated with rotor 17 in such a way that it does not hinder the rotational movement of rotor 17 with respect to stator 16. Valve function pin 35 is virtually only carried along. To enable rotor 17 to be adjusted with respect to stator 16, central locking device 26 is first released by applying pressure medium to locking gate 19 via pressure medium line 18 from the C port of multi-way switching valve 7 with the aid of pressure medium pump P. By applying pressure medium to locking gate 19, locking pins 2 and 5, as well as valve function pin 35, are forced out of locking gate 19, so that rotor 17 is able to subsequently rotate freely with respect to stator 16. To this extent, the camshaft adjusting device corresponds to the prior art.

It is apparent in FIGS. 1 through 3 that, according to the approach according to the present invention, check valves 9 and 10 are situated in a rotor hub 30 of rotor 17 in spatial proximity to locking pins 2 and 5. Locking pin 2 is connected to pressure medium line 27 via second pressure medium line 14. First pressure medium line 1 is furthermore connected to a receiving chamber 43 of locking pin 2 via third and fourth pressure medium lines 8 and 13. Third and fourth pressure medium lines 8 and 13 are fluidically switched in parallel. Third and fourth pressure medium line 8 and 13 are fluidically connected to second pressure medium line 14 as a function of the switching position of a first valve device 36. First valve device 36 is thus formed by receiving chamber 43 and locking pin 2 guided therein. In a first switching position, first valve device 36 fluidically connects third pressure medium line 8 to second pressure medium line 14 via pressure medium line 38 (see FIG. 1). In a second switching position of first valve device 36, the fluidic connection between fourth pressure medium line 13 and second pressure medium line 14 is established via pressure medium line 39 (see FIG. 2). Check valve 9 is situated in third pressure medium line 8, the operating direction of check valve 9 being such that pressure medium is able to flow through it in the direction of working chamber 20. This applies similarly to a second valve device 37, which is formed by a valve pin 5 supported in a receiving chamber 44, the receiving chamber being fluidically connected to second, third and fourth pressure medium lines 33, 31 and 32. In a first switching position, second valve device 37 fluidically connects third pressure medium line 31 to second pressure medium line 33 via pressure medium line 40 (see FIG. 2). In a second switching position of second valve device 37, the fluidic connection between fourth pressure medium line 32 and second pressure medium line 33 is established via pressure medium line 41 (see FIG. 1). Third and fourth pressure medium lines 31 and 32 are fluidically switched in parallel. Check valve 10 is situated in third pressure medium line 31, the operating direction of check valve 10 being set in such a way that pressure medium is able to flow through it only in the direction of working chamber 21.

Locking pins 2 and 5 are spring-loaded in the direction of a first switching position, in which they engage with locking gate 19, as is apparent on the basis of locking pin 2 in FIG. 1. Third pressure medium line 8, including check valve 9 situated therein, is situated in rotor hub 30 in such a way that, in the first position of locking pin 2, it fluidically connects second pressure medium line 14 to third pressure medium line 8 via pressure medium line 38, which, in turn, opens into working chamber 20 via first pressure medium line 1. Pressure medium line 27 is fluidically connected to pressure medium line 4, which opens into working chamber 22, and simultaneously opens into the A port of multi-way valve 7. Check valve 9 is deliberately oriented in such a way that an inflow of the pressure medium into working chamber 20 is possible, while an outflow of the pressure medium from working chamber 20 is prevented. In this position, rotor 17 is not locked after the internal combustion engine is turned off, which may happen, for example, if the internal combustion engine stalls, and rotates in the direction of the "retard" stop position. Locking pin 5 does not engage with locking gate 19 and is shifted against the active spring force into a second switching position, in which a fourth pressure medium line 32 with a free flow-through is fluidically connected to second pressure medium line 33 via pressure medium line 41. Pressure medium lines 3 and 29 are also freely fluidically connected to each other via pressure medium lines 32, 41 and 33. Pressure medium line 29 is fluidically connected to pressure medium line 6 and connected to the B port of multi-way switching valve 7 via pressure medium line 28. Working chambers 20 and 21 of pressure chamber 24 and working chambers 22 and 23 of pressure chamber 25 must be fluidically short-circuited for the freewheel and thus for the movement of the camshaft adjuster into the central locking position. This takes place via valve function pin 35, which is moved from a first switching position into a second switching position by applying pressure medium to locking gate 19 and thus fluidically connects pressure medium line 15 to pressure medium line 34 via pressure medium line 42. As a result, an overflow of the pressure medium is facilitated between two oppositely operating working chambers 20, 21, 22 and 23, this taking place via a check valve 9 and 10 or via fourth pressure medium line 13 and 32 with a free flow-through as a function of the relative angle of stator 16 with respect to rotor 17.

During the start phase of the internal combustion engine, alternating torques act upon the camshaft and thus also upon rotor 17. The torques acting upon rotor 17 in the direction of the arrow result in the fact that the pressure medium is forced out of working chambers 21 and 23 via pressure medium lines 3 and 6. When rotor 17 moves from the "retard" direction into the central locking position, locking pin 5 is in the second switching position, whereby fourth pressure medium line 32 is fluidically connected to second pressure medium line 33 via pressure medium line 41 (see FIG. 1). The pressure medium may thus flow out of pressure medium line 3 into working chamber 20 via pressure medium lines 32, 41, 33, 15, 42, 34, 27, 14, 39, 8 and 1; the flow thus takes place via check valve 9. The pressure medium may furthermore also flow out of working chamber 21 into working chamber 22 via pressure medium lines 3, 32, 41, 33, 15, 42, 34, 27 and 4. The pressure medium from working chamber 23 flows into working chamber 22 via pressure medium lines 6, 29, 15, 42, 34, 27 and 4 and into working chamber 20 via pressure medium lines 6, 29, 15, 42, 34, 27, 14, 38, 8 and 1; the flow also takes place via check valve 9.

Working chambers 20, 21, 22 and 23 are thus short-circuited when torques occur in the direction of the arrow in FIG. 1. Conversely, in the case that torques act against the direction of the arrow, the pressure medium is unable to exit working chamber 20, due to the orientation of check valve 9, and rotor 17 is supported on check valve 9 via the pressure medium in this rotation direction. This virtually effectuates a kind of freewheel, with the aid of which rotor 17 is automatically rotated in a pulsating manner into the central locking position by using the active camshaft alternating torques until locking pin 2 comes into contact laterally with a stop of locking gate 19, and locking pin 5 also locks into locking gate 19, supported by the spring force.

The reverse rotational movement of rotor 17 from the direction of the "advance" stop position in the direction of the central locking position is apparent in FIG. 2. According to the same principle, when torques occur in the direction of the arrow, the pressure medium flows over from working chambers 20 and 22 into oppositely acting working chambers 21 and 23. The excess pressure medium flows out of working chamber 20 into working chamber 21 via pressure medium lines 1, 13, 39, 14, 27, 34, 42, 15, 33, 40, 31 and 3. During this adjusting movement, the pressure medium flows through check valve 10 in third pressure medium line 31, the operating direction of the check valve being such that the pressure medium is able to flow through it in the direction of working chamber 21. However, a back-flow of the pressure medium from working chamber 21 is prevented by check valve 10. The excess pressure medium thus flows out of working chamber 22 into working chamber 21 via pressure medium lines 4, 27, 34, 42, 15, 33, 40, 31 and 3; in this case as well, the pressure medium flows through check valve 10. A reverse rotational movement of rotor 17 is again prevented by the orientation of check valve 10.

In FIG. 3, the camshaft adjusting device is apparent during normal operation when adjusting rotor 17 with respect to stator 16. Multi-way switching valve 7 is shifted out of the first switching position into a second switching position, in which the pressure medium is supplied to the C port and the B port via pressure medium pump P, while it is able to flow back into pressure medium reservoir T via the A port. By applying pressure medium to the C port, the pressure medium is introduced into locking gate 19 via pressure medium line 18, and locking pins 2 and 5 as well as valve function pin 35 are shifted against the active spring force from the first position into the second position, in which working chambers 20 and 22 or 21 and 23 of the same operating direction are fluidically connected to each other via pressure medium lines 13 and 32 with a free flow-through.

Valve function pin 35 is in the second switching position and thus fluidically separates pressure medium lines 15 and 34 from each other. The pressure medium is thus no longer able to flow over between working chambers 20, 21, 22 and 23 of different operating directions. The pressure medium is then introduced from the B port into working chamber 23 via pressure medium lines 28 and 6 and into working chamber 21 via pressure medium lines 28, 29, 33, 41, 32 and 3, so that the volume of working chambers 21 and 23 is increased. At the same time, the pressure medium flows back into pressure medium reservoir T from working chamber 20 via pressure medium lines 1, 13, 39, 14, 27 and from working chamber 22 via pressure medium lines 4 and 27 with the aid of the A port of multi-way switching valve 7, so that the volume of working chambers 20 and 22 is decreased. Due to the changes in volume of working chambers 20, 21, 22 and 23, rotor 17, including vanes 11 and 12, is rotated to the left with respect to stator 16 in the direction of the arrow in the top developed view.

Valve devices 36 and 37 are preferably designed as a 3/2-way valve, as illustrated in FIGS. 1 through 3. Due to the preferred use of the 3/2-way valve, a space-saving line guidance may be implemented. Alternatively, however, it is possible to use, for example, a 2/2-way valve instead of the 3/2-way valve. For this purpose, the two second pressure medium valves 14 and 33 are divided into two fluidically parallel-switched pressure medium lines before they meet receiving chamber 43 or 44 of locking pin 2 or 5.

In the exemplary embodiment illustrated in FIGS. 1 through 3, the fluidic short-circuiting of oppositely acting working chambers 20, 21, 22 and 23 takes place via valve function pin 35. Alternatively, the fluidic short-circuiting may also take place via multi-way switching valve 7. For this purpose, the A port is fluidically short-circuited with the B port, while the C port is fluidically connected to pressure medium reservoir T. Moreover, it is possible to fluidically short-circuit only part of the oppositely acting working chambers 20, 21, 22 and 23 via valve function pin 35. The remaining oppositely acting working chambers 20, 21, 22 and 23 are then fluidically short-circuited via multi-way switching valve 7.

LIST OF REFERENCE NUMERALS

1 first pressure medium line
2 locking pin

3 first pressure medium line
4 pressure medium line
5 locking pin
6 pressure medium line
7 multi-way switching valve
8 third pressure medium line
9 check valve
10 check valve
11 vane
12 vane
13 fourth pressure medium line
14 second pressure medium line
15 pressure medium line
16 stator
17 rotor
18 pressure medium line
19 locking gate
20 working chamber
21 working chamber
22 working chamber
23 working chamber
24 pressure chamber
25 pressure chamber
26 central locking device
27 pressure medium line
28 pressure medium line
29 pressure medium line
30 rotor hub
31 third pressure medium line
32 fourth pressure medium line
33 second pressure medium line
34 pressure medium line
35 valve function pin
36 first valve device
37 second valve device
38 pressure medium line
39 pressure medium line
40 pressure medium line
41 pressure medium line
42 pressure medium line
43 receiving chamber
44 receiving chamber

The invention claimed is:

1. A camshaft adjusting device comprising:

a vane adjuster including a stator connectable to a crankshaft of an internal combustion engine; and a rotor rotatably supported in the stator and connectable to a camshaft, multiple webs being provided on the stator and dividing an annular space between the stator and the rotor into a plurality of pressure chambers;

the rotor including a plurality of vanes extending radially outwardly and dividing the plurality of pressure chambers into a group of first working chambers and a group of second working chambers, the first working chambers having a first operating direction, the second working chambers having a second operating direction different from the first operating direction, a pressure medium circuit being configured such that a pressure medium that is inflowing or outflowing is applicable in the pressure medium circuit to the first working chambers and the second working chambers; and a central locking device for locking the rotor in a central locking position with respect to the stator;

the central locking device including at least two spring-loaded locking pins including a first spring-loaded locking pin in a first receiving chamber and a second spring-loaded locking pin in a second receiving chamber, the first spring-loaded locking pin being lockable in a stator-fixed locking gate, the second spring-loaded locking pin being lockable in the stator-fixed locking gate, the first spring-loaded locking pin locking in the stator-fixed locking gate from a first direction during a rotation of the rotor from an "advance" or a "retard" stop position into the central locking position, the second spring-loaded locking pin locking in the stator-fixed locking gate from a second direction different from the first direction during a rotation of the rotor from the "advance" or the "retard" stop position into the central locking position; the first spring-loaded locking pin forming a valve device together with the first receiving chamber;

a first pressure medium line being freely fluidically connected to a second pressure medium line in a first switching position of the valve device; and the first pressure medium line being fluidically connected to the second pressure medium line via a check valve in a second switching position of the valve device, the check valve being provided outside the first spring-loaded locking pin in the rotor.

2. The camshaft adjusting device as recited in claim 1 wherein the second spring-loaded locking pin forms a further valve device together with the second receiving chamber.

3. The camshaft adjusting device as recited in claim 1 wherein the first pressure medium line is divided into a third pressure medium line including the check valve, and into a fourth pressure medium line with a free flow-through.

4. The camshaft adjusting device as recited in claim 3 wherein the second spring-loaded locking pin forms a further valve device together with the second receiving chamber, a further first pressure medium line being freely fluidically connected to a further second pressure medium line in a first switching position of the further valve device, the further first pressure medium line being fluidically connected to the further second pressure medium line via a further check valve in a second switching position of the further valve device, the further check valve being provided outside the second spring-loaded locking pin in the rotor, the further first pressure medium line being divided into a further third pressure medium line including the further check valve, and into a further fourth pressure medium line with a free flow-through.

5. The camshaft adjusting device as recited in claim 1 wherein at least one of the first working chambers has a volume decreasing during a rotation of the rotor from one of the "advance" or "retard" stop positions toward the central locking position, and is fluidically short-circuited with at least one of the second working chambers, if the valve device is in the second switching position.

6. The camshaft adjusting device as recited in claim 5 wherein a back-flow of the pressure medium from at least one of the second working chambers is prevented by the check valve.

7. The camshaft adjusting device as recited in claim 1 wherein at least one of the first or second working chambers has a volume increasing during a controlled adjustment of the stator with respect to the rotor and is fluidically connected to a pressure medium pump by the valve device.

8. The camshaft adjusting device as recited in claim 1 wherein at least one of the first or second working chambers has a volume decreasing during a controlled adjustment of the stator with respect to the rotor and is fluidically connected to a pressure medium reservoir.

* * * * *